US011952993B2

(12) United States Patent
Sunday

(10) Patent No.: US 11,952,993 B2
(45) Date of Patent: Apr. 9, 2024

(54) COMPRESSOR ASSEMBLY

(71) Applicant: Steven M Sunday, Ft. Worth, TX (US)

(72) Inventor: Steven M Sunday, Ft. Worth, TX (US)

( * ) Notice: Subject to any disclaimer, the term of this patent is extended or adjusted under 35 U.S.C. 154(b) by 0 days.

(21) Appl. No.: 17/876,033

(22) Filed: Jul. 28, 2022

(65) Prior Publication Data

US 2024/0035463 A1 Feb. 1, 2024

(51) Int. Cl.

| | |
|---|---|
| ***F04B 39/14*** | (2006.01) |
| ***F04B 35/01*** | (2006.01) |
| ***F04B 39/12*** | (2006.01) |
| ***F04B 53/22*** | (2006.01) |

(52) U.S. Cl.

CPC ..... *F04B 39/14* (2013.01); *F04B 35/01* (2013.01); *F04B 39/121* (2013.01); *F04B 53/22* (2013.01)

(58) Field of Classification Search

CPC ..... F04B 39/14; F04B 35/01; F04B 39/121; F04B 53/22; F04B 27/04; F04B 27/08; F04B 27/0804; F04B 27/0891; F04B 27/10; F04B 27/1081

See application file for complete search history.

(56) References Cited

U.S. PATENT DOCUMENTS

| | | | | |
|---|---|---|---|---|
| 5,397,218 | A * | 3/1995 | Fujii | F04B 27/1009 91/499 |
| D621,420 | S | 8/2010 | Jiang | |
| 2002/0114709 | A1* | 8/2002 | Murase | F04B 27/1081 417/269 |
| 2021/0404463 | A1* | 12/2021 | Friedrich | F04B 39/121 |

FOREIGN PATENT DOCUMENTS

| | | | | |
|---|---|---|---|---|
| JP | 2013204446 | * | 10/2013 | F04B 27/0878 |

OTHER PUBLICATIONS

JP2013204446 translation (Year: 2023).*

* cited by examiner

*Primary Examiner* — Charles G Freay
*Assistant Examiner* — David N Brandt
(74) *Attorney, Agent, or Firm* — Eric Karich; Karich & Associates

(57) ABSTRACT

A compressor assembly has a pulley assembly and a compressor, with a mounting plate mounted therebetween. The compressor includes a front head, a rear head, and a piston assembly operably mounted between the front head and the rear head. A plurality of case bolts extend through the mounting p late, the front head, and into the rear head.

3 Claims, 2 Drawing Sheets

COMPRESSOR ASSEMBLY

BACKGROUND OF THE INVENTION

Field of the Invention

This invention relates generally to compressors, and more particularly to a compressor assembly that includes a rigid mounting plate attached to a front head of a compressor with a plurality of mounting bolts that extend entirely through the compressor from the front head to the rear head.

Description of Related Art

Compressors used in vehicle air conditioning units are frequently constructed of aluminum. There is a need, however, for compressors that have greater strength and rigidity in the compressor housing. The present invention meets this need by providing a rigid steel mounting plate and a plurality of rigid steel case bolts that extend entirely through the mounting plate and the compressor, from the front head to the rear head. This construction has been found to meet the needs of the market in a preferred construction.

SUMMARY OF THE INVENTION

The present invention teaches certain benefits in construction and use which give rise to the objectives described below.

The present invention provides a compressor assembly that includes the following: a pulley assembly; compressor having a front head, a rear head, and a piston assembly operably mounted between the front head and the rear head; a mounting plate mounted between the pulley assembly and the compressor, so that the mounting plate abuts the front head; and a plurality of case bolts that extend through the mounting plate, the front head, and into the rear head.

A primary objective of the present invention is to provide a compressor assembly having advantages not taught by the prior art.

Another objective is to provide a compressor assembly that includes a rigid mounting plate attached to a front head of a compressor with a plurality of mounting bolts that extend entirely through the compressor from the front head to the rear head.

A further objective is to provide a compressor assembly wherein the rigid mounting plate is constructed of steel, and the front and rear heads of the compressor is constructed of aluminum.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention.

DETAILED DESCRIPTION OF THE INVENTION

The above-described drawing figures illustrate the invention, a compressor assembly that is lightweight and inexpensive due to a primarily aluminum construction, but which also includes components that are constructed of steel to provide superior strength and rigidity.

Figure 1:
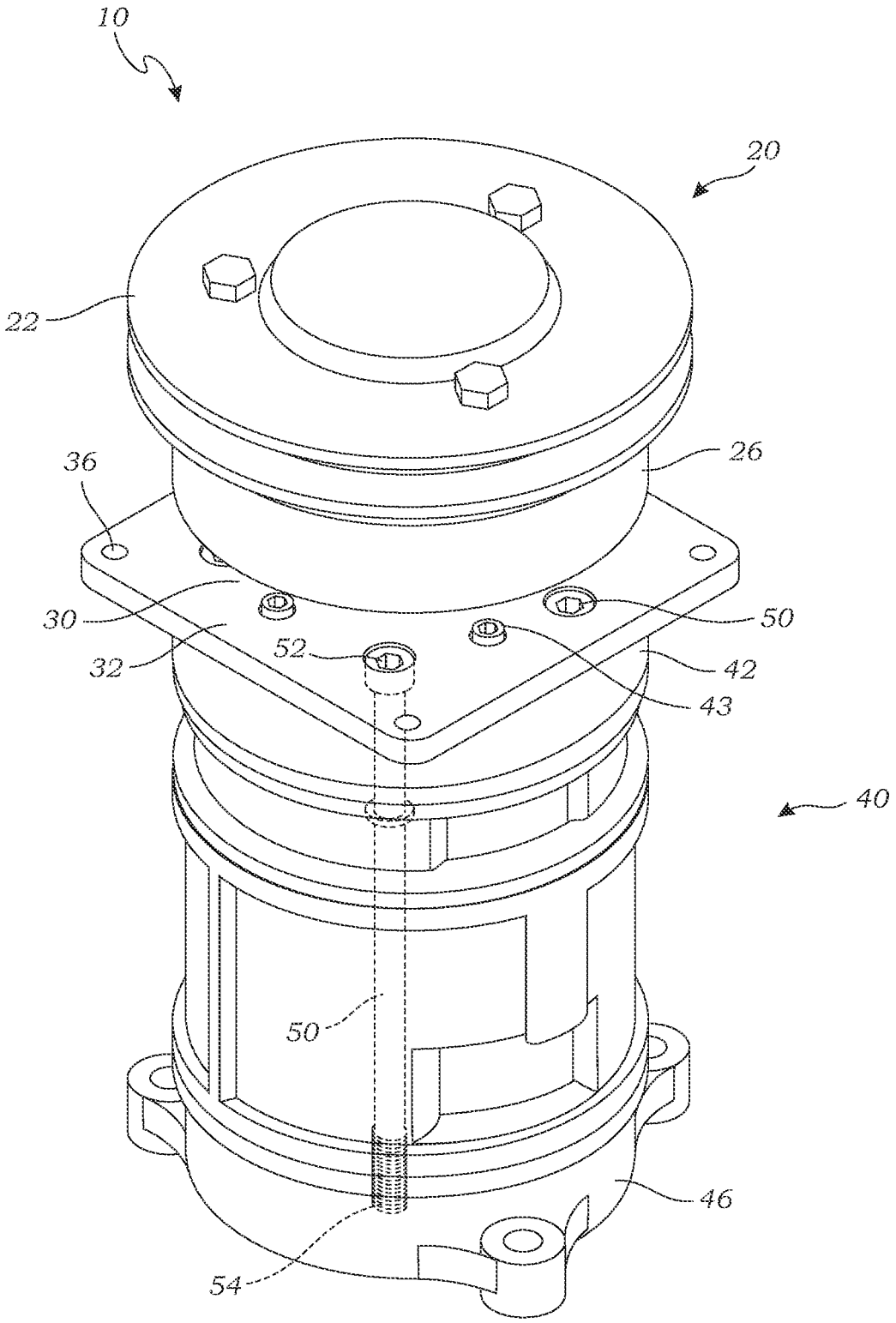
FIG. 1 is a perspective view of a compressor assembly according to one embodiment of the present invention.
Figure 2:
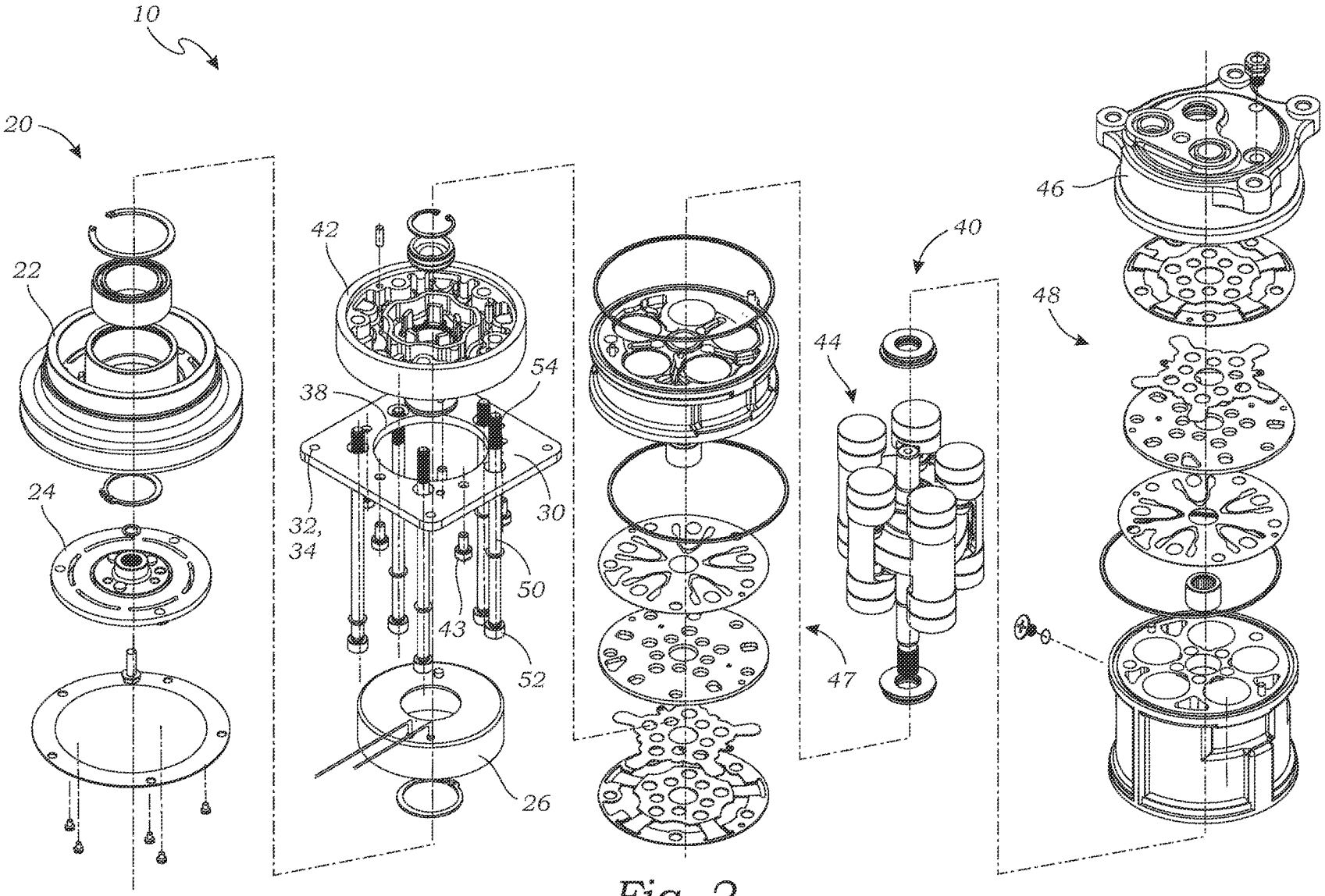
FIG. 2 is an exploded perspective view thereof.

FIG. 1 is a perspective view of one embodiment of the compressor assembly 10. FIG. 2 is an exploded perspective view of the compressor assembly 10. As shown in FIGS. 1-2, the compressor assembly 10 includes a pulley assembly 20, a mounting plate 30, a compressor 40, and a plurality of case bolts 50 which extend through the mounting plate 30 and the compressor 40.

As shown in FIGS. 1-2, the pully assembly 20 includes a pully 22, a clutch 24, an actuator 26, and related components necessary for engagement with a drive belt (not shown) of a vehicle. Since the general construction of the pully assembly 20 is known in the art, it is not described in greater detail herein.

As shown in FIGS. 1-2, the mounting plate 30 is a generally planar steel plate that forms a mounting flange 32 around a center opening 38 (shown in FIG. 2). The mounting plate 30 is completely separate from the compressor, with the mounting plate being made of steel while the compressor is typically made of aluminum. The mounting flange 32 extends outwardly from adjacent a front head 42 of the compressor 40. The mounting flange 32 includes a plurality of apertures 36 therethrough. In this embodiment, the mounting plate 30 is rectangular in construction, forming four corners 34, and wherein the apertures 36 are positioned in the corners 34 of this rectangular shape. These apertures 36 may be used for mounting the compressor assembly 10 in a vehicle (not shown).

As shown in FIGS. 1-2, the compressor 40 includes a front head 42, a piston assembly 44, and a rear head 46, with the piston assembly being operably mounted between the front head 42 and the rear head 46. The compressor may include front valve plates 47 and rear valve plates 48, as well as other related components that are known in the art, and are therefore not discussed in greater detail herein.

The mounting plate 30 is mounted between the pulley assembly 20 and the compressor 40, so that the mounting plate 30 abuts the front head 42 of the compressor 40. In this embodiment, the compressor assembly 10 further comprises fasteners 43 that mount the mounting plate 30 onto the front head 42, but do not extend into the rear head 46. The fasteners 43 may be bolts, screws, or any other form of fastener known in the art. In this embodiment, the front and rear heads 42 and 46 are constructed of aluminum, and the mounting plate 30 is constructed of steel.

The plurality of case bolts 50 extend through the mounting plate 30 and the length of the compressor 40, through the front head 42, and into the rear head 46. In this embodiment, a head 52 of each bolt 50 is engaged with the mounting plate 30, and a threaded distal end 54 threadedly engages the rear head 46. The case bolts 50 of this embodiment are constructed of steel, or some other suitably strong and rigid material. The case bolts 50, in conjunction with the mounting plate 30, provide superior strength and rigidity to the compressor assembly 10.

The title of the present application, and the claims presented, do not limit what may be claimed in the future, based upon and supported by the present application. Furthermore, any features shown in any of the drawings may be combined with any features from any other drawings to form an invention which may be claimed.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A compressor assembly comprising:

a pulley assembly;

a compressor having a front head, a rear head, and a piston assembly operably mounted between the front head and the rear head;

a planar mounting plate mounted between the pulley assembly and the compressor, so that the mounting plate abuts the front head;

fasteners that mount the mounting plate onto the front head, but do not extend into the rear head;

a plurality of case bolts that extend through the mounting plate, the front head, and into the rear head;

wherein the front and rear heads are constructed of aluminum, and the mounting plate is constructed of steel; and wherein the mounting plate forms a mounting flange extending outwardly from the front head, the mounting flange having a plurality of apertures therethrough for mounting the compressor assembly.

2. The compressor assembly of claim 1, wherein the mounting plate is rectangular forming four corners, and wherein the apertures are positioned in the corners.

3. A compressor assembly comprising:

a pulley assembly;

a compressor having a front head, a rear head, and a piston assembly operably mounted between the front head and the rear head, the compressor being constructed of aluminum;

a mounting plate mounted between the pulley assembly and the compressor, so that the mounting plate abuts the front head, the mounting plate being constructed of steel and being a separate structure from the compressor, but attached to the compressor with fasteners;

a plurality of case bolts that extend through the mounting plate, the front head, and into the rear head; and wherein the mounting plate forms a mounting flange extending outwardly from the front head, the mounting flange having a plurality of apertures therethrough for mounting the compressor assembly.

* * * * *